US012037775B2

(12) United States Patent
Hagiwara et al.

(10) Patent No.: US 12,037,775 B2
(45) Date of Patent: Jul. 16, 2024

(54) WORK MACHINE

(71) Applicant: HITACHI CONSTRUCTION MACHINERY CO., LTD., Tokyo (JP)

(72) Inventors: Naoki Hagiwara, Kasumigaura (JP); Kazuhiko Mizoguchi, Ishioka (JP); Keiichirou Anahara, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 341 days.

(21) Appl. No.: 17/436,478

(22) PCT Filed: Apr. 21, 2020

(86) PCT No.: PCT/JP2020/017246
§ 371 (c)(1),
(2) Date: Sep. 3, 2021

(87) PCT Pub. No.: WO2020/218308
PCT Pub. Date: Oct. 29, 2020

(65) Prior Publication Data

US 2022/0170244 A1 Jun. 2, 2022

(30) Foreign Application Priority Data

Apr. 26, 2019 (JP) ..... 2019-086384

(51) Int. Cl.
*E02F 9/26* (2006.01)
*E02F 9/12* (2006.01)
(Continued)

(52) U.S. Cl.
CPC ..... *E02F 9/262* (2013.01); *E02F 9/123* (2013.01); *E02F 9/2033* (2013.01); *E02F 9/24* (2013.01); *E02F 9/265* (2013.01)

(58) Field of Classification Search
CPC ..... E02F 9/121; E02F 9/123; E02F 9/2033; E02F 9/2203; E02F 9/2228; E02F 9/2235;
(Continued)

(56) References Cited

U.S. PATENT DOCUMENTS 9,113,047 B2 * 8/2015 Onuma ..... E02F 9/24
9,598,836 B2 3/2017 Hargrave, Jr. et al.
(Continued)

FOREIGN PATENT DOCUMENTS

CN 108508888 A 9/2018
EP 3604688 A1 2/2020
(Continued)

OTHER PUBLICATIONS

Japanese Office Action received in corresponding Japanese Application No. 2019-086384 dated Sep. 13, 2022.
(Continued)

*Primary Examiner* — Russell Frejd
*Assistant Examiner* — Brandon Z Willis
(74) *Attorney, Agent, or Firm* — MATTINGLY & MALUR, PC

(57) ABSTRACT

A work machine includes a sensor that detects a retroreflective material and other objects in a distinguishable manner, a solenoid valve that restricts an operation signal outputted from an operation device, and a controller configured to control the solenoid valve based on the detection result. The controller controls the solenoid valve based on information concerning whether or not the object detected by the sensor is a retroreflective material and information concerning whether a position of the object detected by the sensor is in a first detection region at least partially including an operation range of a machine body or a second detection region located adjacent to and above the first detection region. This makes it possible to restrain contact between the work
(Continued)

machine and an obstacle while restraining a reduction in a detection range due to exclusion of a structure of the work machine from an object of detection.

6 Claims, 8 Drawing Sheets

(51) Int. Cl.
*E02F 9/20* (2006.01)
*E02F 9/24* (2006.01)

(58) Field of Classification Search
CPC ..... E02F 9/2285; E02F 9/24; E02F 9/26; E02F 9/261; E02F 9/262; E02F 9/264; E02F 9/265; B60W 30/09; B60W 2300/17; B60W 2554/20; B60W 2554/40
See application file for complete search history.

(56) References Cited

U.S. PATENT DOCUMENTS

| | | | | |
|---|---|---|---|---|
| 9,776,566 | B2 * | 10/2017 | Ishimoto | E02F 9/262 |
| 9,836,938 | B2 * | 12/2017 | Kiyota | E02F 9/24 |
| 11,697,920 | B2 * | 7/2023 | Kiyota | E02F 9/26 382/103 |
| 2018/0245315 | A1 | 8/2018 | Kaiso et al. | |
| 2018/0347147 | A1 * | 12/2018 | Doi | E02F 9/2033 |
| 2020/0032489 | A1 * | 1/2020 | Yamazaki | G01S 17/931 |

FOREIGN PATENT DOCUMENTS

| | | | |
|---|---|---|---|
| JP | 07-011672 | A | 1/1995 |
| JP | 2005-032141 | A | 2/2005 |
| JP | 2005-180943 | A | 7/2005 |
| JP | 2012-01995 | A | 1/2012 |
| JP | 2014-218849 | A | 11/2014 |
| JP | 2015-168973 | A | 9/2015 |
| JP | 2015-229836 | A | 12/2015 |
| JP | 2018-62412 | A | 4/2018 |
| JP | 2019-039206 | A | 3/2019 |
| WO | 2012/053105 | A1 | 4/2012 |

OTHER PUBLICATIONS

International Preliminary Report on Patentability received in corresponding International Application No. PCT/JP2020/017246 dated Nov. 4, 2021.
International Search Report of PCT/JP2020/017246 dated Jul. 7, 2020.
Chinese Office Action received in corresponding Chinese Application No. 202080014647.3 dated May 24, 2022.
Extended European Search Report received in corresponding European Application No. 20796273.9 dated Oct. 25, 2022.

* cited by examiner

WORK MACHINE

TECHNICAL FIELD

The present invention relates to a work machine.

BACKGROUND ART

In a work machine such as a hydraulic excavator, a technology of assisting operator's monitoring of the surroundings of the work machine by displaying an image obtained by a camera provided on a machine body on a monitor in a cab has been known.

As a technology concerning such monitoring of the surroundings of a work machine, for example, Patent Document 1 discloses a work vehicle surrounding monitor system in which a monitor region is set in the periphery of a work vehicle and the presence of a worker in the monitor region is detected. The work vehicle surrounding monitor system includes a regressive reflection material worn by the worker, and a surrounding monitor device that applies laser light in a scanning manner from the work vehicle toward the monitor region, receives laser light reflected by the regressive reflection material, and detects the presence of the worker based on a light reception level. The regressive reflection material includes a cube corner reflector in which a multiplicity of cube corner prisms are arranged. The surrounding monitor device includes a coaxial regressive-reflection type photoelectric sensor that applies non-diffused laser light, receives the reflective light substantially coaxially, and outputs a light reception level. A laser light source of the photoelectric sensor is pulse-driven at a predetermined cycle, and the presence of the worker is detected based on the received light pulse.

In addition, Patent Document 2 discloses a construction machine object detection system that detects an object present in the surroundings of a construction machine including an upper swing structure mounted on a lower track structure through a swing mechanism. The construction machine object detection system has an object detection section that detects an object based on an output of a scanning type distance measuring device attached to the upper swing structure. Light emitted from the scanning type distance measuring device passes through a gap between the upper swing structure and the lower track structure. Patent Document 3 discloses an operation restrictor for a construction machine including human detecting means for detecting a human on the basis of a plurality of predetermined ranges set based on front, rear, left, and right directions of the construction machine and a separate distance from the construction machine, selecting means for selecting contents of restriction for the corresponding one of the predetermined ranges in a case where a human is detected by the human detecting means, and restricting means for restricting an operation of the construction machine based on the restriction contents.

PRIOR ART DOCUMENT

Patent Documents

Patent Document 1: JP-2005-032141-A

Patent Document 2: JP-2015-229836-A

Patent Document 3: JP-2014-218849-A

SUMMARY OF THE INVENTION

Problems to be Solved by the Invention

However, in the prior art described in Patent Document 1, though the worker can be detected by applying laser light in a scanning manner and detecting light reflected from a retroreflective material worn by the worker, other materials and obstacles that do not have a retroreflective material cannot be recognized. In addition, in the prior art described in Patent Document 2, a detection range in a vertical direction is restricted by a plane passing through the gap between the upper swing structure and the lower track structure, so that, although the lower track structure swung relative to the upper swing structure can be excluded from the object of detection, a worker or another obstacle located at a position below a lower surface of the upper swing structure cannot be detected. Therefore, for example, even when the technology of Patent Document 3 is applied, the operation of the work machine cannot be suitably restricted when detecting obstacles.

The present invention has been made in consideration of the foregoing. It is an object of the present invention to provide a work machine capable of restraining the contact between the work machine and an obstacle while restraining a reduction in detection range due to exclusion of a structure of the work machine from the object of detection.

Means for Solving the Problems

While the present application includes a plurality of means for solving the above problem, one example thereof is a work machine including an actuator for driving a machine body, an operation device operated for driving the actuator, a sensor provided on the machine body for detecting objects present in surroundings of the machine body, a restrictor that restricts the driving of the actuator by the operation device, and a controller configured to control the restrictor based on a detection result of the sensor. The sensor is capable of detecting a specific object from among the objects in a distinguishable manner. The controller is configured to control, in a case where an object is detected by the sensor, the restrictor based on information concerning whether or not the object detected by the sensor is the specific object and information concerning whether a position of the object detected by the sensor is in a first detection region set so as to at least partially include an operation range of the machine body or a second detection region located adjacent to and above the first detection region.

Advantages of the Invention

According to the present invention, the contact between the work machine and an obstacle can be restrained while restraining a reduction in detection range due to exclusion of a structure of the work machine from the object of detection.

MODE FOR CARRYING OUT THE INVENTION

An embodiment of the present invention will be described below referring to FIGS. 1 to 9. Note that, while in the present embodiment a hydraulic excavator is described as an example of a work machine, the present invention is also applicable to other work machines such as a crane and road machines such as a wheel loader.

Figure 1:
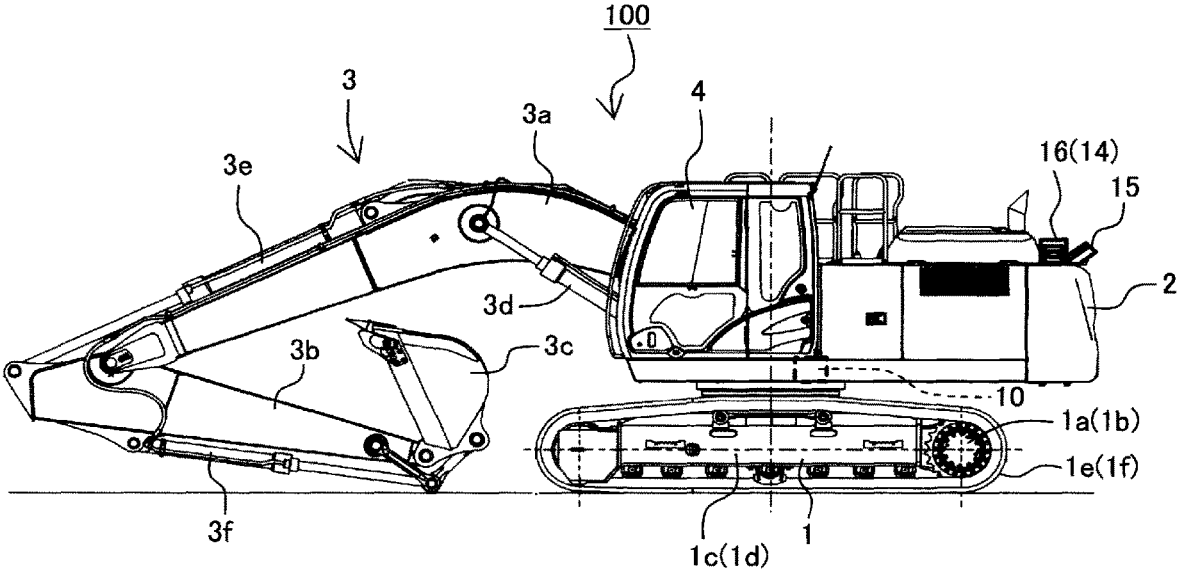
FIG. 1 is a side view schematically depicting an appearance of a hydraulic excavator as an example of a work machine.
Figure 2:
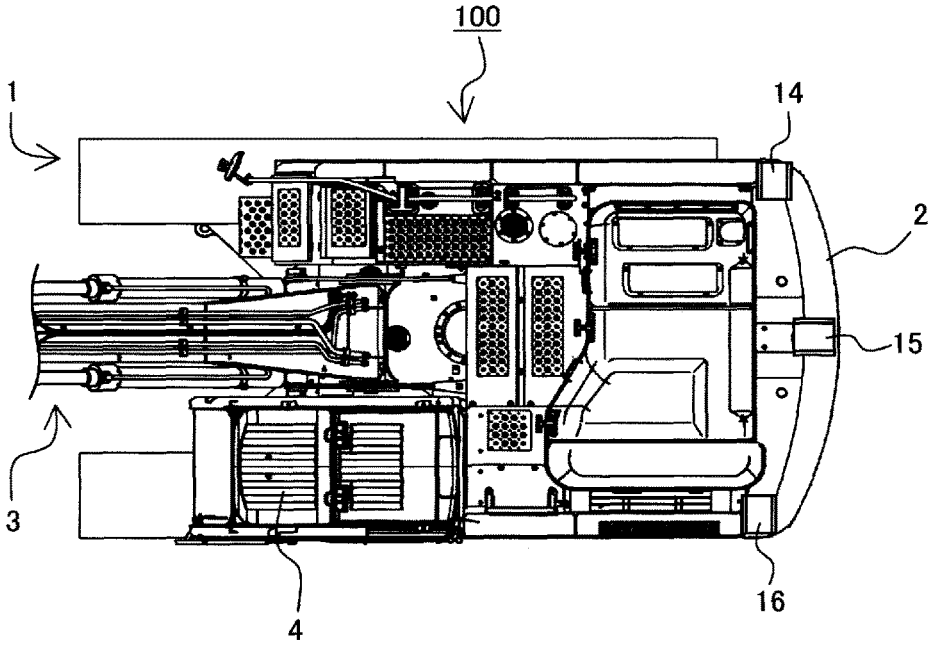
FIG. 2 is a top plan view schematically depicting the appearance of the hydraulic excavator as an example of the work machine.
Figure 3:
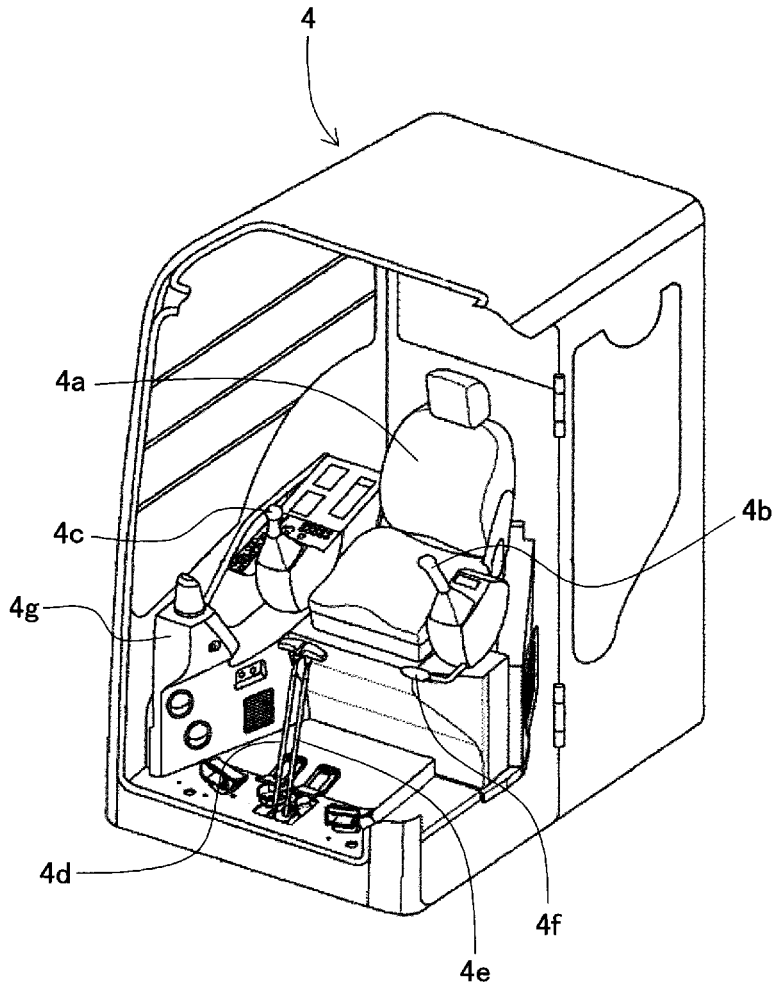
FIG. 3 is a diagram depicting a state inside a cab.

FIGS. 1 and 2 are diagrams schematically depicting an appearance of a hydraulic excavator as an example of the work machine according to the present embodiment, FIG. 1 being a side view and FIG. 2 being a top plan view. In addition, FIG. 3 is a diagram depicting a state in a cab.

In FIGS. 1 and 2, the hydraulic excavator 100 generally includes a machine body including a crawler type lower track structure 1 and an upper swing structure 2 provided swingably relative to the lower track structure 1, and a front work implement 3 provided on a front side of the upper swing structure 2 in an elevatable manner. Note that a part of the front work implement 3 is omitted in FIG. 2 for simplification of illustration.

The front work implement 3 is configured by coupling a plurality of driven members (a boom 3*a*, an arm 3*b*, and a bucket 3*c*) each rotated vertically. A base end of the boom 3*a* is rotatably supported on a front portion of the upper swing structure 2. In addition, one end of the arm 3*b* is rotatably coupled to a tip end of the boom 3*a*, and the bucket 3*c* is rotatably coupled to the other end (tip end) of the arm 3*b*. The boom 3*a*, the arm 3*b*, and the bucket 3*c* are respectively driven by a boom cylinder 3*d*, an arm cylinder 3*e*, and a bucket cylinder 3*f* which are hydraulic actuators.

The lower track structure 1 includes a pair of crawlers 1*e* and 1*f* respectively wrapped around a pair of left and right crawler frames 1*c* and 1*d*, and track hydraulic motors 1*a* and 1*b* as hydraulic actuators for driving the respective crawlers 1*e* and 1*f* through speed reduction mechanisms and the like. Note that, in FIG. 1, in regard of each configuration of the lower track structure 1, only one of a pair of left and right configurations is illustrated and denoted by a reference character, while the other configuration is only denoted by a parenthesized reference character and is omitted from illustration.

The upper swing structure 2 includes each member disposed on a swing frame serving as a base, and the swing frame is driven to swing relative to the lower track structure 1 by a swing hydraulic motor 10 which is a hydraulic actuator, whereby the upper swing structure 2 can swing relative to the lower track structure 1.

Figure 4:
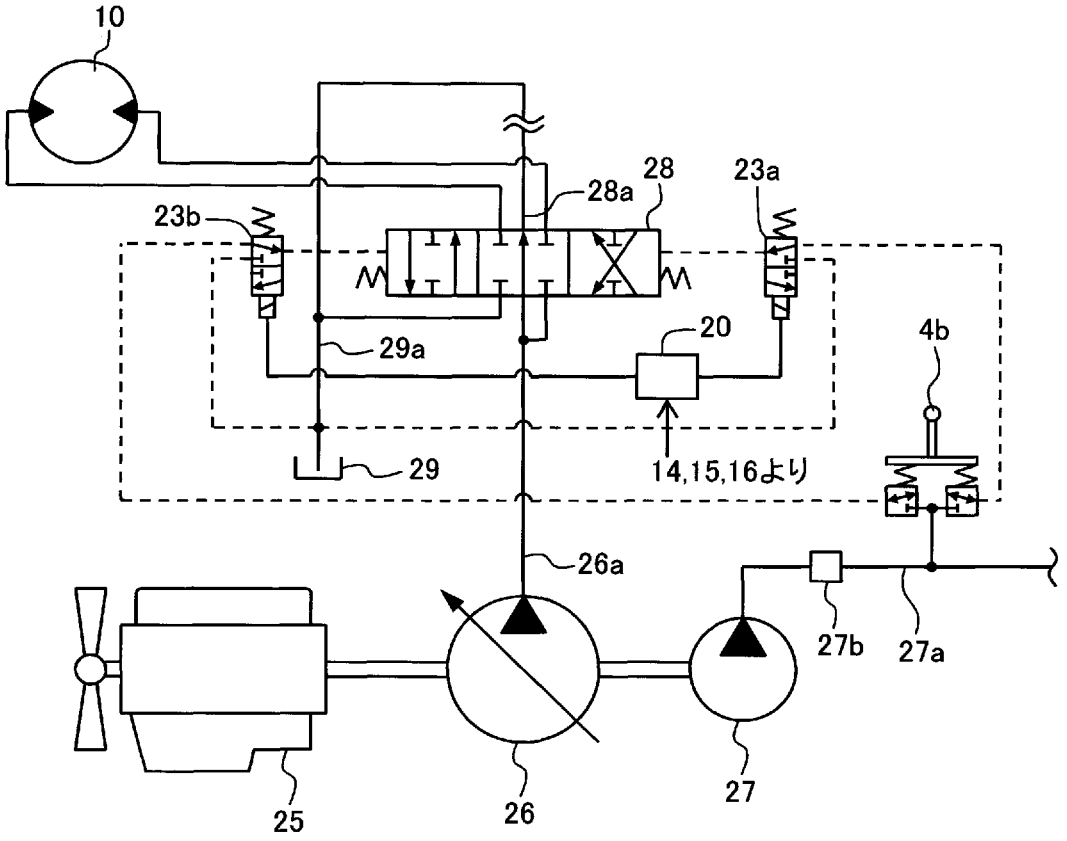
FIG. 4 is a diagram schematically extracting a part of a hydraulic circuit system applied to the hydraulic excavator together with related configurations.

On a front side of the swing frame of the upper swing structure 2, a cab 4 on which an operator rides to operate the hydraulic excavator 100 is disposed; in addition, an engine 25 as a prime mover, a hydraulic pump 26 and a pilot pump 27 driven by the engine 25, and a hydraulic circuit system for driving hydraulic actuators (the track hydraulic motors 1*a* and 1*b*, the swing hydraulic motor 10, the boom cylinder 3*d*, the arm cylinder 3*e*, the bucket cylinder 3*f*) are mounted (see FIG. 4 described later). Besides, a controller 20 configured to control operations of the hydraulic excavator 100 as a whole is disposed on the upper swing structure 2.

As illustrated in FIG. 3, disposed in the cab 4 are a seat 4*a* on which the operator is seated, operation devices 4*b*, 4*c*, 4*d*, and 4*e* for performing operations such as a driving operation of the front work implement 3, a swing operation of the upper swing structure 2, and a traveling operation of the lower track structure 1, a gate lock lever 4*f*, and the like. In addition, in the cab 4, a monitor 4*g* is disposed at such a position as to be easily viewed from the operator seated on the seat 4*a* and not to hinder the operator from viewing the outside of the cab 4.

A plurality of sensors 14 to 16 for imaging the surroundings of the upper swing structure 2 are mounted on left and right sides and a rear side of an upper portion of the upper swing structure 2. The plurality of sensors 14 to 16 are respectively referred to as a right side sensor 14, a rear side sensor 15, and a left side sensor 16 according to the layout thereof. In other words, the plurality of sensors 14 to 16 include the left side sensor 16 which is provided on a rear side of the cab 4 on the left side of the upper swing structure 2 and a detection range of which includes the front side and the left side of the upper swing structure 2, the right side sensor 14 which is provided on the right side of the upper swing structure 2 and a detection range of which includes the front side and the right side of the upper swing structure 2, and the rear side sensor 15 which is provided on the rear side of the upper swing structure 2 and a detection range of which includes the left and right sides and the rear side of the upper swing structure 2.

FIG. 4 is a diagram schematically extracting a part of a hydraulic circuit system applied to the hydraulic excavator together with related configurations. Note that, in FIG. 4, a configuration of the swing hydraulic motor 10 is depicted as a representative of the plurality of hydraulic actuators of the hydraulic excavator 100.

In FIG. 4, the hydraulic circuit system includes the engine 25 as a prime mover, the hydraulic pump 26 and the pilot pump 27 driven by the engine 25, the plurality of hydraulic actuators (here, only the swing hydraulic motor 10 is illustrated) driven by a hydraulic fluid delivered from the hydraulic pump 26, a plurality of directional control valves (here, only a directional control valve 28 for the swing hydraulic motor 10 is illustrated) that control flows of hydraulic fluids supplied from the hydraulic pump 26 to the plurality of hydraulic actuators, and the plurality of hydraulic pilot type operation devices (here, only the operation device 4*b* concerning a swing operation is illustrated) that instruct operations of the plurality of hydraulic actuators and generate pilot pressures (operation signals) for changing over the plurality of directional control valves.

The directional control valve 28 is of a center bypass type, and has a center bypass passage located on a center bypass line 28*a*. The center bypass passage is connected in series with the center bypass line 28*a*, the center bypass passage communicates with the center bypass line 28*a* when a spool of the directional control valve 28 is in a neutral position, and the communication of the center bypass passage with the center bypass line 28*a* is interrupted when the spool of the directional control valve 28 is changed over to a changeover position on the left side or the right side in FIG. 4. The upstream side of the center bypass line 28*a* is connected to a delivery line 26*a* of the hydraulic pump 26, and a downstream side of the center bypass line 28*a* is connected to a tank line 29*a*.

The directional control valve 28 can be changed over by a pilot pressure (operation signal) from the operation device 4*b*. The operation device 4*b* has a pair of pilot valves that generate a pilot pressure with a delivery pressure of the pilot pump 27 as a source pressure, according to an operation amount. For example, when the operation device 4*b* is operated from the neutral position to a direction corresponding to a left swing (for example, the left side), a pilot pressure generated in one of the pilot valves according to the operation amount is outputted to a pressure receiving section on the right side in FIG. 4 of the directional control valve 28, whereby the directional control valve 28 is changed over to the changeover position on the right side in FIG. 4. As a result, the swing hydraulic motor 10 is rotated, and the upper swing structure 2 is swung in a leftward direction relative to the lower track structure 1. On the other hand, for example, when the operation device 4*b* is operated from the neutral position to a direction corresponding to a right swing (for example, the right side), a pilot pressure generated in the other pilot valve according to the operation amount is outputted to a pressure receiving section on the left side in FIG. 4 of the directional control valve 28, whereby the directional control valve 28 is changed over to the changeover position on the left side in FIG. 4. As a result, the swing hydraulic motor 10 is rotated, and the upper swing structure 2 is swung in a rightward direction relative to the lower track structure 1.

Solenoid valves 23*a* and 23*b* are provided in respective lines from the operation device 4*b* to the two pressure receiving sections of the directional control valve 28. The solenoid valves 23*a* and 23*b* are restrictors that restrict a pilot pressure (operation signal) outputted from the operation device 4*b* to the directional control valve 28, and restrict the pilot pressure (operation signal) based on a solenoid valve current (command signal) from the controller 20 described later, to thereby restrict an operation velocity of the swing hydraulic motor which is a hydraulic actuator.

Figure 6:
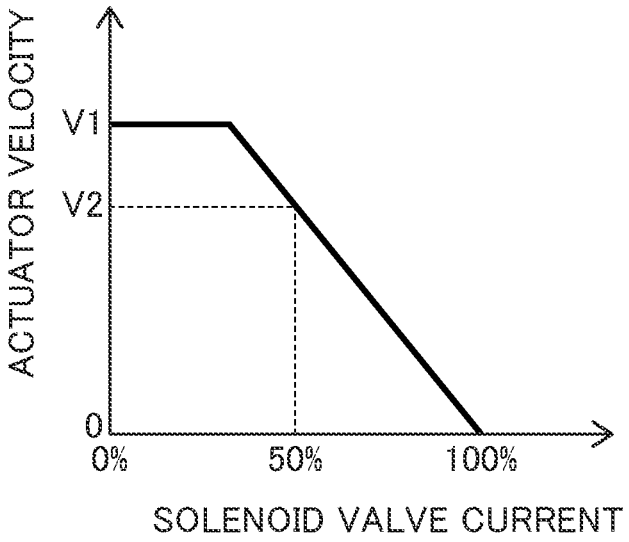
FIG. 6 is a diagram depicting a relation between a solenoid valve current outputted from a controller to a solenoid valve and an actuator velocity.

FIG. 6 is a diagram depicting a relation between a solenoid valve current outputted from the controller to the solenoid valve and an actuator velocity. The axis of abscissas in FIG. 6 represents proportions of the solenoid valve currents outputted from the controller 20 to the solenoid valves 23*a* and 23*b* based on a prescribed value. Here, the value of the solenoid valve current at which the solenoid valves 23*a* and 23*b* are fully closed is 100%. In addition, the axis of ordinates in FIG. 6 represents the velocity of the hydraulic actuator, when the pilot pressure outputted from the operation device 4*b* to the directional control valve 28 is not restricted, as V1. In other words, in FIG. 6, when the solenoid valve current is 0 (zero) %, the hydraulic actuator is operated at a velocity V1 according to the pilot pressure outputted from the operation device 4*b*; when the solenoid valve current increases to exceed a certain proportion, the velocity of the hydraulic actuator is restricted attendant on the increase of the solenoid valve current; when the solenoid valve current becomes 50%, the velocity of the hydraulic actuator is restricted to V2 (<V1); and when the solenoid valve current becomes 100%, the velocity of the hydraulic actuator is restricted to 0 (zero).

A pilot relief valve (not illustrated) that holds the delivery pressure of the pilot pump 27 constant is provided in a delivery line 27*a* of the pilot pump 27. In addition, a lock valve 27*b* is provided in the delivery line 27*a* of the pilot pump 27, and the lock valve 27*b* can be changed over according to an operation of the gate lock lever 4*f*. The gate lock lever 4*f* is provided with a position switch (not illustrated) which is put into a closed state when the gate lock lever 4*f* is in an unlocked position (lowered position) and which is put into an open state when the gate lock lever 4*f* is in a locked position (raised position). For example, when the position switch is put into the closed state, a solenoid section of the lock valve 27*b* is energized through the position switch, and the lock valve 27*b* is changed over to a communication position. As a result, the delivery line 27*a* of the pilot pump 27 is put into communication, and the delivery pressure of the pilot pump 27 is introduced to the operation device 4*b* and the like. As a result, a pilot pressure is generated by an operation of the operation device 4*b* or the like, and the hydraulic actuator can be caused to work (operable state). On the other hand, when the position switch is put into the open state, the lock valve 27*b* is put into an interrupting position. As a result, communication of the delivery line 27*a* of the pilot pump 27 is interrupted. Consequently, a pilot pressure is not generated even if the operation device 4*b* or the like is operated, and the hydraulic actuator is not caused to work (inoperable state).

Note that a hydraulic circuit system concerning the left and right track hydraulic motors 1*a* and 1*b*, the boom cylinder 3*d*, the arm cylinder 3*e*, and the bucket cylinder 3*f* which are not illustrated in FIG. 4 also has a similar configuration.

In addition, solenoid valves 24*a* and 24*b* are provided in respective lines from the operation devices 4*d* and 4*e* at least concerning a traveling operation to the two pressure receiving sections of the respective directional control valves (not illustrated) for the hydraulic motors 1*a* and 1*b*, and pilot pressures (operation signals) are restricted based on the solenoid valve currents (command signals) from the controller 20, whereby operation velocities of the track hydraulic motors 1*a* and 1*b* which are hydraulic actuators are restricted.

The hydraulic excavator 100 in the present embodiment configured as above has a surrounding monitor function that restricts operations of the hydraulic excavator 100 based on the detection results of the sensors 14 to 16.

Figure 5:
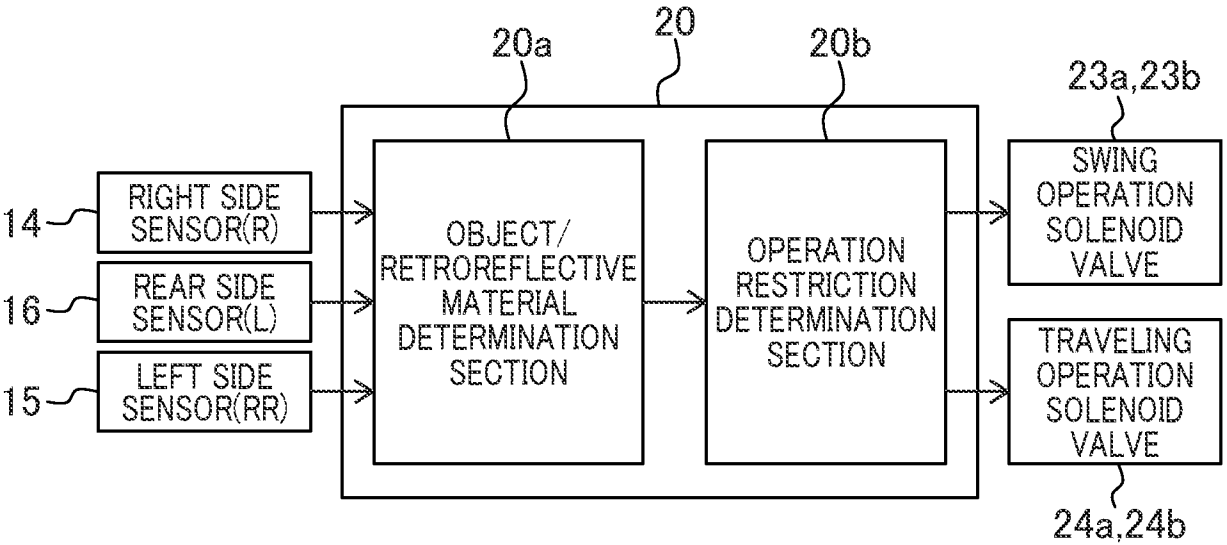
FIG. 5 is a functional block diagram schematically extracting a configuration concerning a surrounding monitor function of the hydraulic excavator.

FIG. 5 is a functional block diagram schematically extracting a configuration concerning the surrounding monitor function of the hydraulic excavator according to the present embodiment.

In FIG. 5, the surrounding monitor function includes the plurality of sensor 14 to 16, the solenoid valves 23*a*, 23*b*, 24*a*, and 24*b* as restrictors, and the controller 20 configured to generate command signals to the solenoid valves 23*a*, 23*b*, 24*a*, and 24*b* based on the detection results of the plurality of sensors 14 to 16.

The sensors 14 to 16 are sensors that detect distances and directions from the sensors 14 to 16 to an object and output a position of the detected object in a three-dimensional coordinate system as a detection result, and are, for example, infrared depth sensors. In addition, the sensors 14 to 16 are capable of detecting a retroreflective material and other members (objects) in a distinguishable manner, and output information concerning whether or not the object detected as a detection result is a retroreflective material.

Figure 7:
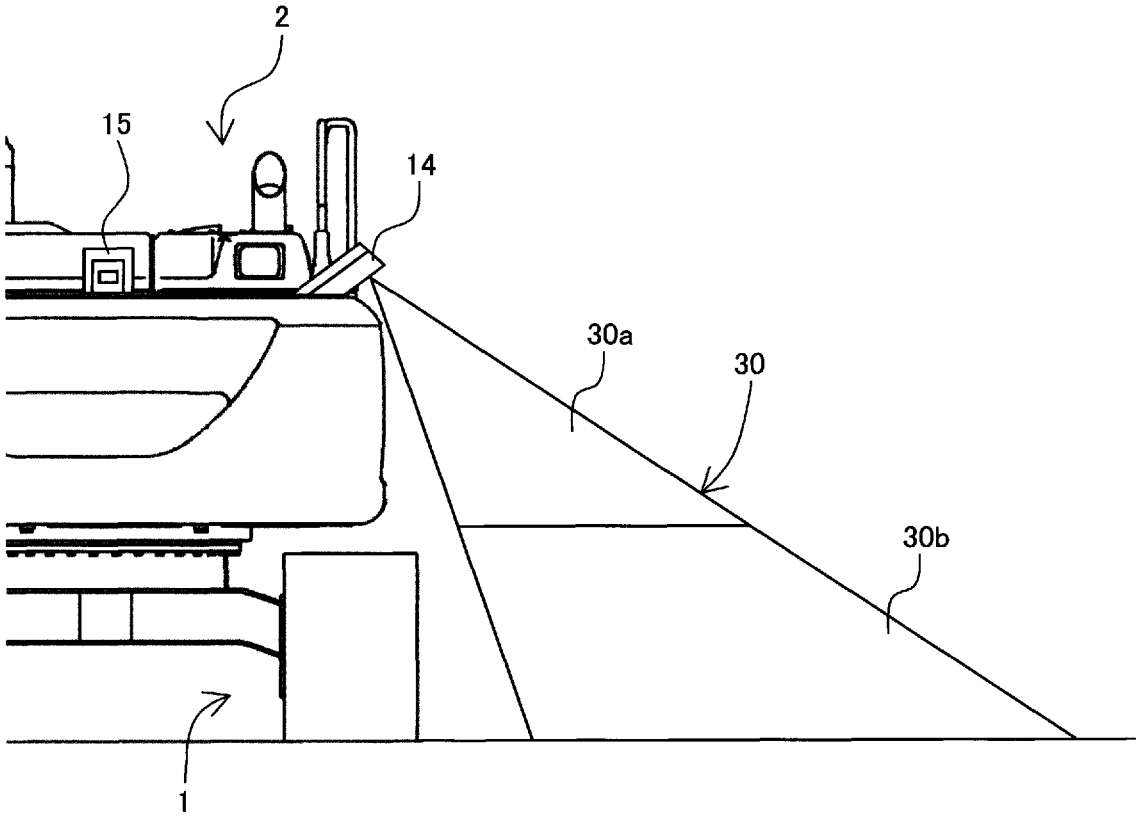
FIG. 7 is a diagram depicting an example of a detection range of a sensor.

FIG. 7 is a diagram depicting an example of a detection range of a sensor.

In FIG. 7, the detection range of the right side sensor 14 of the sensors 14 to 16 is depicted on a representative basis. As illustrated in FIG. 7, a detection range 30 of the sensor 14 is defined by a first detection region 30*b* set so as to at least partially include an operation range of the lower track structure 1 relative to the upper swing structure 2, and a second detection region 30*a* set so as to be adjacent to the first detection range 30*b*, and a boundary between the first detection region 30*b* and the second detection region 30*a* is set along a virtual plane perpendicular to a swing shaft of the upper swing structure 2 at a height between a lower end of the upper swing structure 2 and an upper end of the lower track structure 1. This setting of the detection range is stored in a storage region (not illustrated) of the controller 20, and can be adjusted, for example, through an external apparatus for maintenance or the like.

The first detection region 30*b* and the second detection region 30*a* are each determined in terms of an object (member) as the object of detection by the sensor 14. Of a retroreflective material worn by a worker operating in the surroundings of the hydraulic excavator 100 and other objects, the first detection region 30*b* is a detection region whose detection object is only the retroreflective material. In addition, the second detection region 30*a* is a detection region whose detection object is both the retroreflective material and the other objects. In other words, the controller 20 has acquired information concerning the three-dimensional position of the detected object and information concerning the kind of the detected object (whether or not the detected object is the retroreflective material), as a detection result from the sensor 14. In a case where the three-dimensional position where an object is detected is in the first detection region 30*b*, it is determined that an object is detected only when the detected object is a retroreflective material. Even if an object other than the retroreflective material such as the lower track structure 1 is detected, it is determined that the detection of an object is absent. In addition, in a case where the three-dimensional position where an object is detected is in the second detection region 30*a*, the controller 20 determines that an object is detected no matter whether the detected object is a retroreflective material or another object.

The controller 20 has an object/retroreflective material determination section 20*a* and an operation restriction determination section 20*b*.

Figure 8:
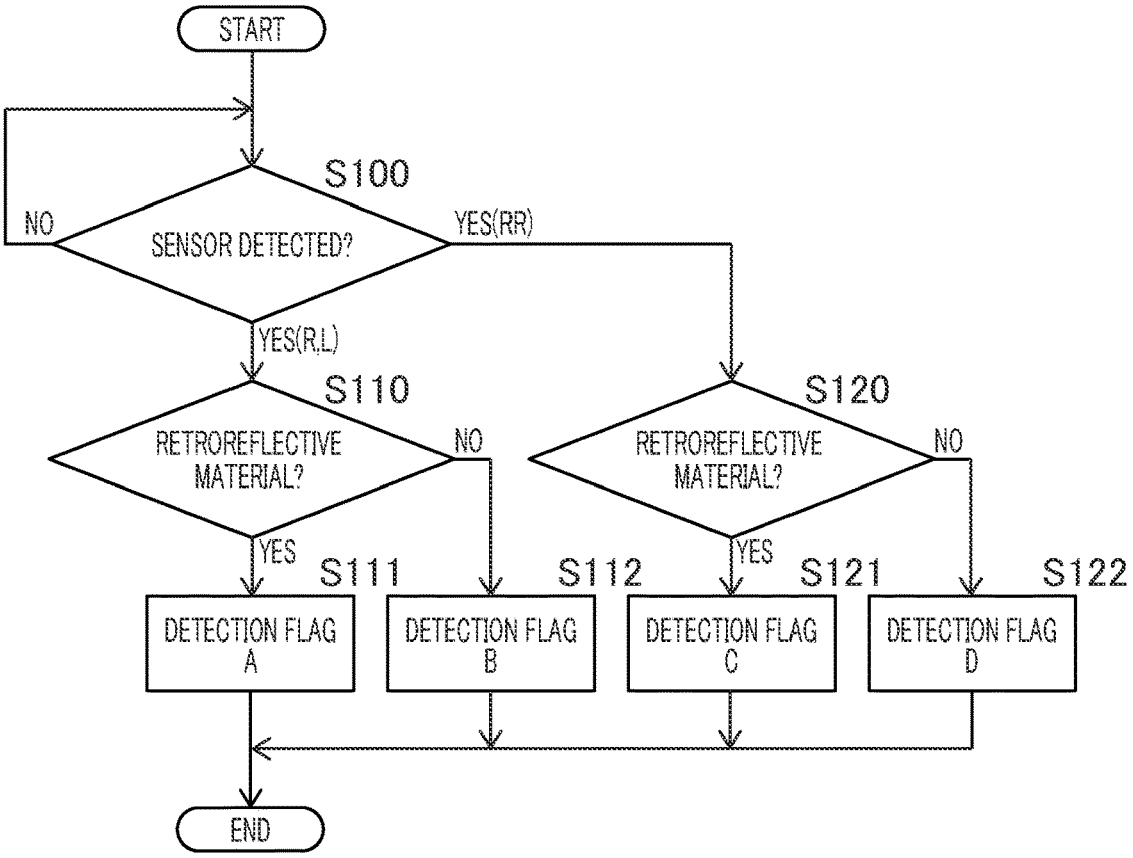
FIG. 8 is a flow chart depicting contents of processing of an object/retroreflective material determination section.
Figure 9:
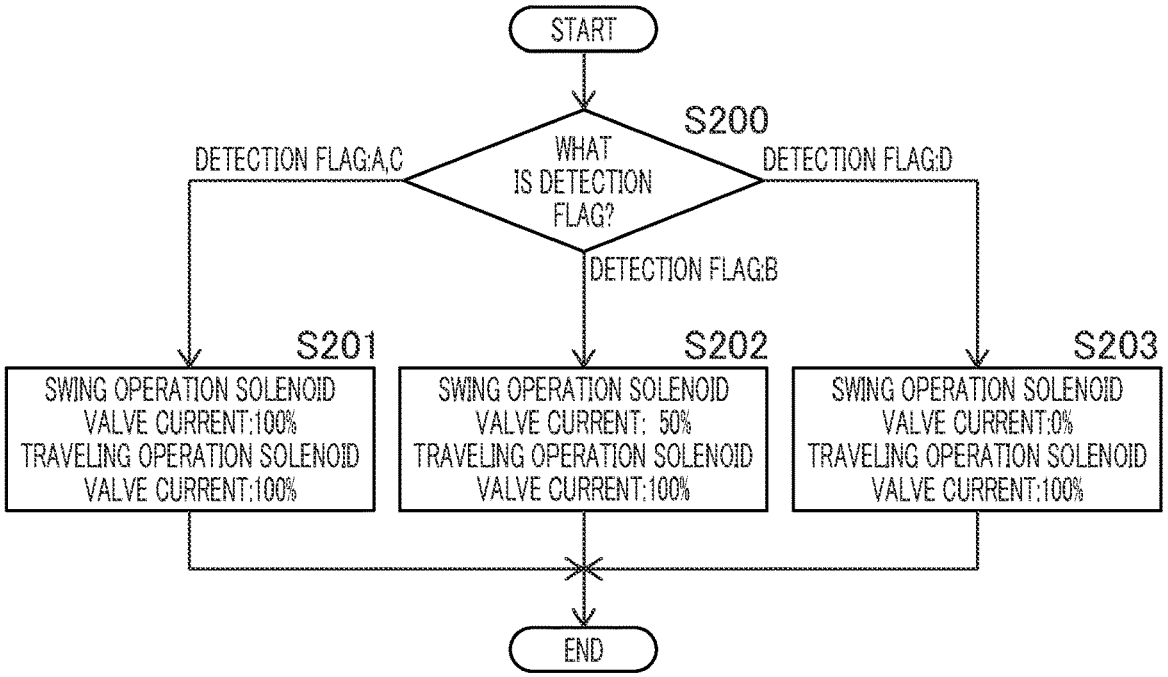
FIG. 9 is a flow chart depicting contents of processing of an operation restriction determination section.

FIG. 8 is a flow chart indicating contents of processing by the object/retroreflective material determination section, and FIG. 9 is a flow chart indicating contents of processing by the operation restriction determination section.

As depicted in FIG. 8, the object/retroreflective material determination section 20*a* first determines whether or not an object is detected based on detection results from the sensors 14 to 16 (step S100). Specifically, as described above, it is determined whether a retroreflective material is detected in the first detection region 30*b*, or whether either object is detected in the second detection region 30*a*. When the determination result in step S100 is NO, the processing of step S100 is repeated until an object is detected.

In addition, when the determination result in step S100 is YES and the sensor having detected an object is the right side sensor 14 or the left side sensor 16, it is determined whether the detected object includes a retroreflective material (step S110), a detection flag A is outputted to the operation restriction determination section 20*b* when the determination result is YES (step S111), whereas a detection flag B is outputted to the operation restriction determination section 20*b* when the determination result is NO (step S112), and the processing is finished.

In addition, when the determination result of step S100 is YES and the sensor having detected an object is the rear side sensor 15, it is determined whether or not the detected object includes a retroreflective material (step S120), a detection flag C is outputted to the operation restriction determination section 20*b* when the determination result is YES (step S121), whereas a detection flag D is outputted to the operation restriction determination section 20*b* when the determination result is NO (step S122), and the processing is finished.

Subsequently, the operation restriction determination section 20*b* determines what the detection flag outputted from the object/retroreflective material determination section 20*a* is (step S200). When the detection flag is determined to be A or C, the solenoid valve currents outputted to the solenoid valves 23*a* and 23*b* for swing and the solenoid valve currents outputted to the solenoid valves 24*a* and 24*b* for traveling are both made to be 100%, whereby a swing operation and a traveling operation are stopped (step S201), and the processing is finished. In other words, when it is considered that a worker wearing a retroreflective material is detected, both a swing operation and a traveling operation are stopped, whereby contact of the hydraulic excavator 100 with the worker can be prevented.

In addition, when it is determined that the detection flag is B in step S200, the solenoid valve currents outputted to the solenoid valves 23*a* and 23*b* for swing are set to 50%, whereas the solenoid valve currents outputted to the solenoid valves 24*a* and 24*b* for traveling are set to 100%, whereby the operation speed of a swing operation is decelerated and a traveling operation is stopped (step S202), and the processing is finished. In other words, when an object other than a retroreflective material (namely, an object other than a worker) is detected on a lateral side of the hydraulic excavator 100 (specifically, a lateral side of the upper swing structure 2), the swing speed is not stopped but is decelerated and the traveling operation is stopped, whereby the contact with the object detected on the lateral side can be suitably restrained while restraining a decrease in operating efficiency.

In addition, when it is detected that the detection flag is D in step S200, the solenoid valve currents outputted to the solenoid valves 23*a* and 23*b* for swing are set to 0 (zero) % and the solenoid valve currents outputted to the solenoid valves 24*a* and 24*b* for traveling are set to 100%, whereby the operation speed of a swing operation is not restricted and a traveling operation is stopped (step S203), and the processing is finished. In other words, when an object other than a retroreflective material (namely, an object other than a worker) is detected on the rear side of the hydraulic excavator 100 (specifically, on the rear side of the upper swing structure 2), the swing speed is maintained and a traveling operation is stopped, whereby the contact with the object detected on the rear side can be suitably restrained while restraining a decrease in operating efficiency.

Effects of the present embodiment configured as above will be described.

In a conventional technology of detecting a worker by applying laser light in a scanning manner and detecting light reflected from a retroreflective material worn by the worker, other materials or obstacles not having a retroreflective material cannot be recognized. In addition, in a conventional technology in which the detection range in the vertical direction is restricted by a plane passing between the upper swing structure and the lower track structure, though the lower track structure swung relative to the upper swing structure can be excluded from the object of detection, a worker or other obstacles located at a position lower than the lower surface of the upper swing structure cannot be detected. Therefore, for example, even when the conventional technology of restricting an operation of a work machine in a case where an obstacle is detected is applied, the operation of the work machine cannot be suitably restricted when the obstacle is detected.

On the other hand, the present embodiment provides the hydraulic excavator 100 including the operating devices 4*b* to 4*e* that output operation signals for driving the track hydraulic motors 1*a* and 1*b*, the hydraulic cylinders 3*d* to 3*f*, and the swing hydraulic motor 10 which are hydraulic actuators, the sensors 14 to 16 capable of detecting a retroreflective material which is a specific object and other objects in a distinguishable manner, the solenoid valves 23*a*, 23*b*, 24*a*, and 24*b* as restrictors that restrict driving of the hydraulic actuators by restricting operation signals outputted from the operation devices 4*b* to 4*e*, and the controller 20 configured to control the solenoid valves 23*a*, 23*b*, 24*a*, and 24*b* based on detection results of the sensors 14 to 16. In the hydraulic excavator 100, the controller 20 is configured to control, in a case where an object is detected by the sensors 14 to 16, the solenoid valves 23*a*, 23*b*, 24*a*, and 24*b* based on the information concerning whether or not the object (member) detected by the sensors 14 to 16 is a retroreflective material and the information concerning whether the position of the object (member) detected by the sensors 14 to 16 is in the first detection region 30*b* at least partially including the operation range of the machine body or the second detection region 30*a* adjacent to the first detection region 30*b*. Therefore, the contact of the hydraulic excavator 100 with an obstacle can be restrained while restraining a reduction in the detection range due to exclusion of the structure of the hydraulic excavator 100 from the object of detection.

Figure 10:
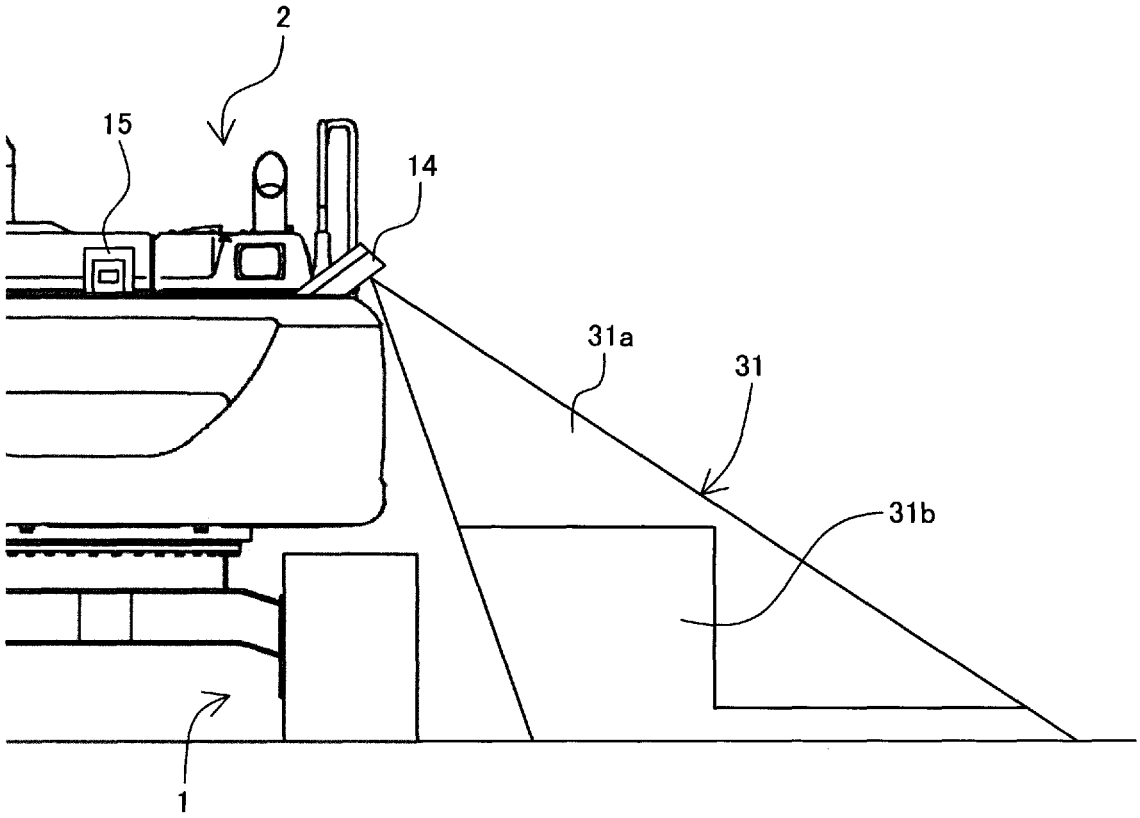
FIG. 10 is a diagram depicting another example of the detection range of the sensor.

Note that the setting of the detection regions is not limited to the one described referring to FIG. 7; for example, as depicted in FIG. 10, in regard of a detection range 31 of the sensor 14, a range corresponding to the operation range of the lower track structure 1 relative to the upper swing structure 2 may be set as a first detection region 31*b*, and the other region may be set as a second detection region 31*a*. With the first detection region 31*b* thus set based on the operation range of the lower track structure 1, detection of an object can be performed more accurately.

The characteristic features of the present embodiment configured as above will be described.

(1) In the above embodiment, in the work machine (for example, the hydraulic excavator 100) including the actuators (for example, the track hydraulic motors 1*a* and 1*b*, the swing hydraulic motor 10) for driving the machine body (for example, the lower track structure 1 and the upper swing structure 2), the operation devices 4*b* to 4*e* operated for driving the actuators, the sensors 14 to 16 that are provided on the machine body and detect objects present in the surroundings of the machine body, the restrictors (for example, the solenoid valves 23*a*, 23*b*, 24*a*, and 24*b*) that restrict the driving of the actuators by the operation devices, and the controller 20 configured to control the restrictors based on detection results of the sensors, the sensors are capable of detecting a specific object from among the objects in a distinguishable manner, and the controller is configured to control, in a case where an object is detected by a sensor, the restrictors based on the information concerning whether or not the object detected by the sensor is the specific object and the information concerning whether the position of the object detected by the sensor is in the first detection region 30*b* set so as to at least partially include the operation range of the machine body or the second detection region 30*a* set so as to be adjacent to and above the first detection region.

As a result, the contact between the work machine and an obstacle can be restrained while restraining a reduction in the detection range due to exclusion of the structure of the work machine from the object of detection.

(2) In addition, in the above embodiment, in the work machine (for example, the hydraulic excavator 100) of (1) above, the controller 20 is configured to control the restrictors (for example, the solenoid valves 23*a*, 23*b*, 24*a*, and 24*b*) when the objects is detected in the second detection region and when the specific object is detected in the first detection region.

(3) Beside, in the above embodiment, in the work machine (for example, the hydraulic excavator 100) of (2) above, the controller 20 is configured not to perform control by the restrictors (for example, the solenoid valves 23*a*, 23*b*, 24*a*, and 24*b*) in a case where the objects is detected in the first detection region, the objects is not detected in the second detection region, and further the objects detected is not the specific object.

(4) In addition, in the above embodiment, in the work machine (for example, the hydraulic excavator 100) of (1) above, the sensors 14 to 16 are infrared depth sensors.

(5) Besides, in the above embodiment, in the work machine (for example, the hydraulic excavator 100) of (1) above, the specific object is a retroreflective material.

(6) In addition, in the above embodiment, in the work machine (for example, the hydraulic excavator 100) of (1) above, the machine body includes the upper swing structure 2 and the lower track structure 1, and the restrictors (for example, the solenoid valves 23*a*, 23*b*, 24*a*, and 24*b*) restrict at least either one of an traveling operation of the lower track structure and a swing operation of the upper swing structure relative to the lower track structure.

(7) Besides, in the above embodiment, in the work machine (for example, the hydraulic excavator 100) of (1) above, the machine body includes the upper swing structure 2 and the lower track structure 1, and at least a part of the boundary between the first detection region 30*b* and the second detection region 30*a* is set so as to be between the lower end of the upper swing structure and the upper end of the lower track structure.

ADDITIONAL REMARK

Note that the present invention is not limited to the above-described embodiment, and includes various modifications and combinations within such a range as not to depart from the gist of the invention. In addition, the present invention is not limited to the one including all the configurations described in the above embodiment, and includes those in which some of the configurations are deleted. Besides, the above configurations, functions, and the like may be partly or entirely realized by, for example, designing in the form of an integrated circuit or the like. In addition, the above configurations, functions, and the like may be realized by software by a processor interpreting and executing programs for realizing the respective functions.

DESCRIPTION OF REFERENCE CHARACTERS

1: Lower track structure

1*a*, 1*b*: Track hydraulic motor

1*c*, 1*d*: Crawler frame
1*e*, 1*f*: Crawler
2: Upper swing structure
3: Front work implement
3*a*: Boom
3*b*: Arm
3*c*: Bucket
3*d*: Boom cylinder
3*e*: Arm cylinder
3*f*: Bucket cylinder
4: Cab
4*a*: Seat
4*b* to 4*e*: Operation device
4*f*: Gate lock lever
4*g*: Monitor
10: Swing hydraulic motor
14: Right side sensor
14: Sensor
15: Rear side sensor
15: Sensor
16: Left side sensor
16: Sensor
20: Controller
20*a*: Object/retroreflective material determination section
20*b*: Operation restriction determination section
23*a*, 23*b*: Solenoid valve
24*a*, 24*b*: Solenoid valve
25: Engine
26: Hydraulic pump
26*a*: Delivery line
27: Pilot pump
27*a*: Delivery line
27*b*: Lock valve
28: Directional control valve
28*a*: Center bypass line
30, 31: Detection range
30*a*, 31*a*: Second detection region
30*b*, 31*b*: First detection region
29*a*: tank line
100: Hydraulic excavator

The invention claimed is:

1. A work machine comprising:

an actuator for driving a machine body;

an operation device operated for driving the actuator;

a sensor provided on the machine body for detecting objects present in surroundings of the machine body;

a restrictor that restricts the driving of the actuator by the operation device; and a controller configured to control the restrictor based on a detection result of the sensor, wherein the sensor is capable of detecting a specific object from among the objects sensor is configured to detect, and wherein a detection range of the sensor is set to include a first detection region that at least partially includes an operation range of the machine body and a second detection region located adjacent to and above the first detection region in a vertical direction of the machine body, and wherein the controller is configured to restrict, in a case where an object is detected in the first detection region by the sensor, the actuator by the restrictor only when the detected object is the specific object, and restrict, in a case where an object is detected in the second detection region by the sensor, the actuator by the restrictor even if the detected object is not the specific object.

2. The work machine according to claim 1, wherein the controller is configured not to perform control by the restrictor in a case where the objects are detected in the first detection region, the objects are not detected in the second detection region, and further the objects detected are not the specific object.

3. The work machine according to claim 1, wherein the sensor is an infrared depth sensor.

4. The work machine according to claim 1, wherein the specific object is a retroreflective material.

5. The work machine according to claim 1, wherein the machine body includes an upper swing structure and a lower track structure, and wherein the restrictor restricts at least one of a traveling operation of the lower track structure and a swing operation of the upper swing structure relative to the lower track structure.

6. The work machine according to claim 1, wherein the machine body includes an upper swing structure and a lower track structure, and wherein at least a part of a boundary between the first detection region and the second detection region is set so as to be between a lower end of the upper swing structure and an upper end of the lower track structure.

* * * * *